United States Patent [19]

Brunfeldt

[11] Patent Number: 4,465,930

[45] Date of Patent: Aug. 14, 1984

[54] GLASS INLET SYSTEM FOR MASS SPECTROMETER

[76] Inventor: Robert J. Brunfeldt, Box 3636, Bartlesville, Okla. 74003

[21] Appl. No.: 392,729

[22] Filed: Jun. 28, 1982

[51] Int. Cl.[3] ..... H01J 49/04

[52] U.S. Cl. ..... 250/288

[58] Field of Search ..... 250/288

[56] References Cited

U.S. PATENT DOCUMENTS 3,594,574 7/1971 Morgan et al. ..... 250/288

*Primary Examiner*—Alfred E. Smith
*Assistant Examiner*—Jack I. Berman
*Attorney, Agent, or Firm*—Head, Johnson & Stevenson

[57] ABSTRACT

An improved all glass heated inlet system for a mass spectrometer wherein the specific improvement comprises providing the interface between two separable polished glass flats with a groove that is substantially surrounded by an essentially continuous matrix of glass and connected to a vacuum source during operation, such as to create a sample vacuum lock that exhibits greater stability and more uniform expansion and contraction during heat up or cool down.

3 Claims, 2 Drawing Figures

GLASS INLET SYSTEM FOR MASS SPECTROMETER

BACKGROUND OF THE INVENTION

1. Field of the Invention

This invention relates to an improved glass inlet system for injecting a sample into a mass spectrometer or the like. More specifically, the invention relates to a vacuum lock for an inlet system with improved performance during heat up.

2. Description of the Prior Art

The introduction or injection of a small sample of vapors of a high molecular weight compound into various scientific apparatus, equipment, analytical instrument, or the like has historically presented a serious problem. In order to volatilize such a sample high temperatures and low pressures are required. Such conditions inherently imply heating with an associated thermal expansion problem as well as sample stability or compatibility considerations. Thus, in designing and building an acceptable sample inlet system, particularly when the system is to be used repeatedly such as when a series of samples are to be injected into a mass spectrometer, one must account for repeated expansion and contraction.

One of the earliest designs for a mass spectrometer inlet system which required high temperature vaporization of the sample was a gallium covered glass frit inlet. Later, a gallium orifice inlet was introduced that eliminated the problem of sample fractionation caused by the frit, but had an upper temperature limit of about 300° C. and retained the property of potential catalytic reaction by contact of the sample with hot gallium. Various all glass inlet systems have also been described in scientific literature. In one system a weighed sample sealed in a capillary tube is introduced into an expansion vessel and then broken with a magnetic plunger. Another all glass heated mass spectrometer inlet which extends the upper operating temperature from about 300° to 450° C. for very small samples (0.1 milligrams) is disclosed in J. Mass Spectrometry and Ion Physics (1968), pages 87–92 and is the subject matter of U.S. Pat. No. 3,594,574. This inlet system includes a valved manifold and a vacuum lock for sealingly connecting a sample container to the manifold. The lock chamber is formed by two concentric tubes joined at one end by a ring seal and polished to an optical flat mating surface at the other end. A vacuum outlet tube is connected to the annular space or central chamber between the concentric tubes such that a sample ampoule tube with optical flat mating surface can be held against this vacuum lock during operation. This optical flat vacuum lock inlet system has proved to be a reliable method for introducing small samples at higher temperatures without loss of vacuum in the mass spectrometer, yet is limited in that the presence of the concentric tubes create dissimilar rates of thermal expansion upon heating. The present invention is viewed as a specific improvement to the glass inlet system of U.S. Pat. No. 3,594,574.

SUMMARY OF THE INVENTION

In view of the thermal expansion problem associated with prior art glass inlet systems wherein the sample container involves a glass joint consisting of a pair of mated polished glass flats that separate to accept a sample and are held together under vacuum during sample injection, I have discovered a specific improvement comprising; at least one groove in one of the polished glass flats that encircles the sample container at the interface between the flats and wherein the groove is substantially surrounded by a continuous matrix of glass such that both sides of the groove are exposed to the same temperature change essentially as a single unit and wherein said groove is connected to a vacuum source during use of the inlet system thus creating a sample vacuum lock.

This improved glass inlet is particularly useful for mass spectrometer sample injection. it is envisioned that the use of the groove as a vacuum lock allows for more uniform thermal conduction and expansion of the glass vacuum seal, thus increasing the overall tolerance for rapid heating and cooling with decreased incidence of leakage across the seal.

It is a primary object of the present invention to provide in a glass vacuum lock sample inlet system, an inexpensive and highly reliable method and apparatus for improving the inlet system tolerance to rapid temperature changes without breaking or disrupting the vacuum seal. It is an associated object that this be accomplished by minimizing the occurrence of dissimilar relative rates of expansion between glass elements of the overall system. Fulfillment of these objects and the presence and fulfillment of other objects will be apparent upon complete reading of the specification and claims taken in conjunction with the attached drawing.

DESCRIPTION OF THE PREFERRED EMBODIMENT

Figure 1:
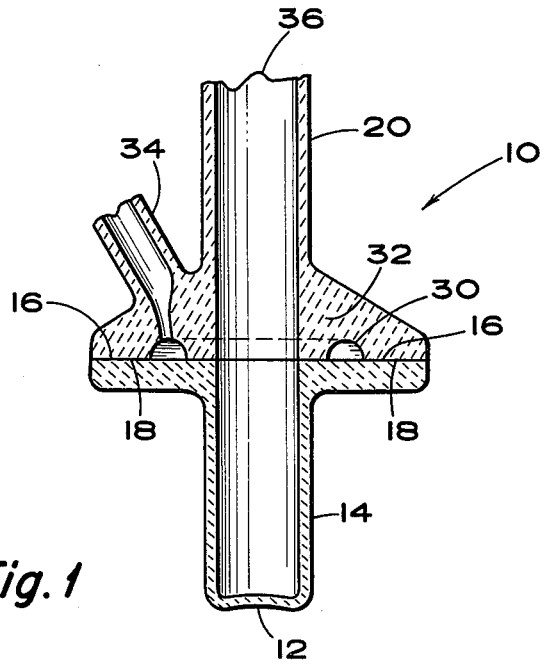
FIG. 1 is a cross-sectional view of the improved glass inlet system according to the present invention.
Figure 2:
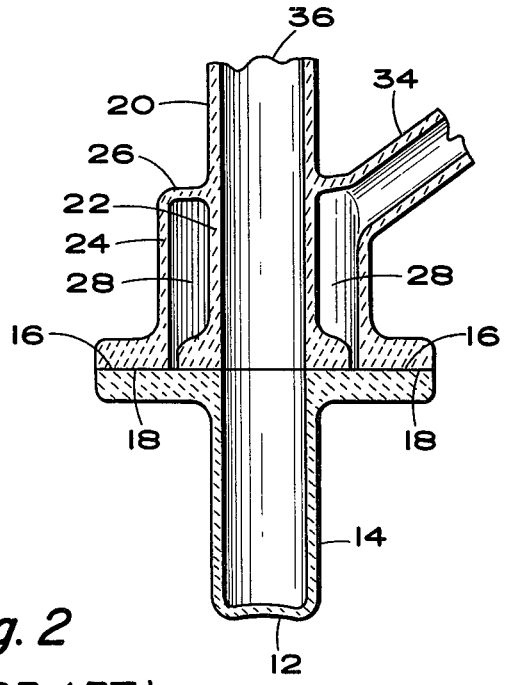
Fig. 2 (PRIOR ART)
FIG. 2 is a cross-sectional view of a glass inlet system of the prior art.

The improved all glass sample inlet system of the present invention, how it functions and how it differs from the prior art can perhaps be best explained and understood by reference to the drawings. FIG. 1 illustrates a cross-sectional view of a glass inlet system according to the present invention generally designated by the numeral 10. FIG. 2 illustrates a cross-sectional view of a glass inlet system of the prior art. Both devices, as illustrated, have a lower glass sample ampoule container or chamber 12 which is essentially a glass test tube 14 that terminates at the top in a flat mating surface 16. This flat mating surface 16 is one of a pair of optical flats 16 and 18 that make the optical flat vacuum lock or interface between the lower ampoule chamber 12 and the upper vacuum lock chamber 20. The mating surfaces 16 and 18 are hand ground to provide a surface flatness as taught in the prior art. It is the specific physical structure of this vacuum lock chamber 20 that serves to distinguish the present improved inlet system from that disclosed in the prior art and illustrated in FIG. 2.

As illustrated in FIG. 2, the prior art vacuum lock chamber is formed from two concentric tubes 22 and 24 joined at the top by a ring of glass 26. In this manner, the prior art device is characterized in that it has an internal annular space or center chamber 28. In contrast, the present invention has a small diameter groove 30 that encircles the entire optical flate 18 and internal opening of sample ampoule 12. The sample inlet system of the present invention is further characterized in that the groove 30 is substantially surrounded by a continuous matrix of glass 32 such that both sides of the groove are exposed to the same external temperature change simultaneously. Each of the devices are further equipped with a vacuum source tube 34 which connects to the groove 30 in FIG. 1 and to the annular space 28 of FIG. 2.

In operation both the improved inlet system 10 and the prior art inlet system connect or lead to a mass spectrometer or other specific instrument through tube 36. The optically polished mating surfaces 16 and 18 are separated (in the absence of a vacuum) by applying a shearing force at the glass joint or interface that causes the surfaces 16 and 18 to slide and part from each other. The appropriate sample is then placed in the bottom of ampoule tube 12 and the polished mating surfaces 16 and 18 are realigned. A vacuum is then applied to the corresponding vacuum lock via tube 34 and the interior of the sample chamber 12 is either purged with an inert gas or evacuated with a vacuum (or both), thus isolating the sample of analysis. Upon heating the entire glass inlet system to volatilize the sample, any gas leaking across the interface of the polished glass flats, whether it be from the exterior inward or from the interior outward, will be drawn off through tube 34, thus eliminating sample contamination.

After sample injection, the inlet system can be cooled back to room temperature, repressurized, and then disassembled for insertion of the next sample to be tested. A more complete description of the operating techniques of the overall mass spectrometer system to which the improved inlet system can be attached and the methods and techniques of manufacturing the polished optical flats of the inlet system can be found in the previously referenced J. Mass Spectrometry and Ion Physics article and U.S. Pat. No. 3,594,574. As such, these references are incorporated by reference for such purposes.

The advantages of the present invention are viewed as being related to the aforementioned structural differences in the upper vacuum lock portion of the inlet system. In the prior art device, the presence of the concentric glass tubing with a vacuum applied to the inner annular chamber results in extremely poor thermal contact between the outer surrounding glass of the inlet system and the inner portion of the system. In other words, the inner concentric glass tube 22 of FIG. 2 would be thermally insulated from the remaining portion of the inlet system during the heat up of the sample. Consequently, a tendency for significantly dissimilar expansion would inherently occur resulting in increased risk of leakage across the interface between the polished flats. The presence of a groove surrounded by a continuous layer of glass in the improved inlet system results in increased thermal contact and more uniform expansion and contraction during temperature changes. Consequently, the tendency for leakage across the seal is significantly reduced.

Having thus described the preferred embodiments of the invention with a certain degree of particularity, it is manifest that many changes can be made in the details of construction, arrangement and fabrication of the elements and their uses without departing from the spirit and scope of the invention. Therefore, it is to be understood that the invention is not to be limited to the embodiment set forth herein for purposes of exemplification, but is to be limited only by the scope of the attached claims, including a full range of equivalents to which each element thereof is entitled.

I claim:

1. In a glass inlet system wherein the sample container involves a glass joint consisting of a pair of mated polished glass flats that separate to accept a sample and are held together under vacuum during sample injection, the specific improvement comprising; at least one groove in one of said polished glass flats that encircles said sample container at the interface between said flats and wherein said groove is substantially surrounded by a continuous matrix of glass such that both sides of said groove are exposed to the same temperature change essentially as a single unit and wherein said groove is connected to a vacuum source during the use of the inlet system thus creating a sample vacuum lock.

2. An improved glass inlet system of claim 1 wherein said system is a mass spectrometer inlet system.

3. An improved glass inlet system of claim 2 wherein said groove is the upper of said polished glass flats opposite the lower sample ampoule polished glass flat.

* * * * *